US011017627B2

(12) United States Patent
Shigeta

(10) Patent No.: US 11,017,627 B2
(45) Date of Patent: May 25, 2021

(54) CARD GAME MONITORING SYSTEM

(71) Applicant: ANGEL PLAYING CARDS CO., LTD., Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 0 days.

(21) Appl. No.: 16/000,056

(22) Filed: Jun. 5, 2018

(65) Prior Publication Data

US 2018/0286171 A1 Oct. 4, 2018

Related U.S. Application Data

(63) Continuation of application No. 15/112,038, filed as application No. PCT/JP2015/000171 on Jan. 16, 2015.

(51) Int. Cl.
*G07F 17/32* (2006.01)

(52) U.S. Cl.
CPC ..... *G07F 17/3206* (2013.01); *G07F 17/322* (2013.01); *G07F 17/3248* (2013.01); *G07F 17/3276* (2013.01); *G07F 17/3293* (2013.01)

(58) Field of Classification Search
CPC ..... G07F 17/3206; G07F 17/322; G07F 17/3248; G07F 17/3276; G07F 17/3293
USPC ..... 463/25
See application file for complete search history.

(56) References Cited

U.S. PATENT DOCUMENTS 5,781,647 A 7/1998 Fishbine et al.
6,093,103 A 7/2000 McCrea
6,117,012 A 9/2000 McCrea
6,460,848 B1 10/2002 Soltys et al.
6,514,140 B1 2/2003 Storch
6,582,301 B2 6/2003 Hill
(Continued)

FOREIGN PATENT DOCUMENTS

AU 2012201094 A1 3/2012
CA 2543251 A1 10/2000
(Continued)

OTHER PUBLICATIONS

European Search Report dated Sep. 25, 2018 for EPApplication 18187764.8.
(Continued)

*Primary Examiner* — Omkar A Deodhar
*Assistant Examiner* — Shauan-Kay Hall
(74) *Attorney, Agent, or Firm* — Norton Rose Fulbright US LLP

(57) ABSTRACT

The card game monitoring system comprises a game table on which bettors put wagers on betting areas; and a card shooter apparatus has a card reading unit to read and record the number (rank) and suit of the cards; and a control unit to determine a winning hand according to a table game rules based on information of numbers (ranks) and suits of the cards sequentially read by the card reading unit; a monitor video camera system to capture positions of cards and to identify wagers on each betting area at the game table; the control unit has further processing function to check whether wagers with payoff move to a pool of the winner of the bettors determined by the card shooter apparatus at the end of each game.

8 Claims, 2 Drawing Sheets

(56) References Cited

U.S. PATENT DOCUMENTS

| | | | | |
|---|---|---|---|---|
| 6,908,385 | B2 * | 6/2005 | Green | G07F 17/32 463/16 |
| 8,337,296 | B2 | 12/2012 | Grauzer et al. | |
| 2002/0045476 | A1 | 4/2002 | Poole et al. | |
| 2002/0045479 | A1 | 4/2002 | Soltys et al. | |
| 2002/0089120 | A1 | 7/2002 | Miller | |
| 2002/0155869 | A1 | 10/2002 | Soltys et al. | |
| 2003/0064798 | A1 | 4/2003 | Grauzer et al. | |
| 2003/0195025 | A1 | 10/2003 | Hill | |
| 2003/0232651 | A1 | 12/2003 | Huard et al. | |
| 2005/0012270 | A1 | 1/2005 | Schubert | |
| 2005/0026680 | A1 | 2/2005 | Gururajan | |
| 2005/0051965 | A1 | 3/2005 | Gururajan | |
| 2005/0062226 | A1 * | 3/2005 | Schubert | A63F 1/14 273/149 R |
| 2005/0137005 | A1 | 6/2005 | Soltys et al. | |
| 2005/0148391 | A1 | 7/2005 | Tain | |
| 2005/0258597 | A1 | 11/2005 | Soltys et al. | |
| 2005/0272501 | A1 | 12/2005 | Tran et al. | |
| 2005/0288086 | A1 | 12/2005 | Schubert et al. | |
| 2006/0063577 | A1 | 3/2006 | Downs, III | |
| 2006/0177109 | A1 | 8/2006 | Storch | |
| 2006/0183540 | A1 | 8/2006 | Grauzer et al. | |
| 2006/0199649 | A1 | 9/2006 | Soltys et al. | |
| 2006/0202422 | A1 | 9/2006 | Bahar | |
| 2006/0217199 | A1 | 9/2006 | Adcox et al. | |
| 2007/0015583 | A1 | 1/2007 | Tran | |
| 2007/0178955 | A1 | 8/2007 | Mills | |
| 2008/0113783 | A1 | 5/2008 | Czyzewski et al. | |
| 2008/0180250 | A1 | 7/2008 | Steil | |
| 2008/0303210 | A1 * | 12/2008 | Grauzer | A63F 13/80 273/149 R |
| 2009/0104961 | A1 | 4/2009 | Hamada et al. | |
| 2009/0131151 | A1 * | 5/2009 | Harris | G07F 17/32 463/22 |
| 2009/0140492 | A1 | 6/2009 | Yoseloff et al. | |
| 2009/0143141 | A1 | 6/2009 | Wells et al. | |
| 2009/0191933 | A1 | 7/2009 | French | |
| 2009/0233699 | A1 | 9/2009 | Koyama | |
| 2009/0273141 | A1 | 11/2009 | Bahar | |
| 2010/0207324 | A1 | 8/2010 | Soltys et al. | |
| 2011/0052049 | A1 | 3/2011 | Rajaraman et al. | |
| 2011/0079959 | A1 | 4/2011 | Hartley | |
| 2011/0127722 | A1 * | 6/2011 | Emori | G07F 17/32 273/274 |
| 2011/0227703 | A1 | 9/2011 | Kotab | |
| 2012/0080845 | A1 | 4/2012 | Emori et al. | |
| 2012/0231866 | A1 * | 9/2012 | Witty | G07F 11/32 463/17 |
| 2013/0109455 | A1 | 5/2013 | Grauzer et al. | |
| 2014/0094239 | A1 | 4/2014 | Grauzer et al. | |
| 2015/0087417 | A1 | 3/2015 | George et al. | |
| 2015/0375096 | A1 | 12/2015 | Jackson et al. | |

FOREIGN PATENT DOCUMENTS

| | | | |
|---|---|---|---|
| CN | 102125756 | A | 7/2011 |
| CN | 102892472 | A | 1/2013 |
| EP | 2613298 | A1 | 7/2013 |
| WO | 98/33566 | A1 | 8/1998 |
| WO | 01/91866 | A1 | 12/2001 |
| WO | 2005/025701 | A2 | 3/2005 |

OTHER PUBLICATIONS

Singaporean Office Action dated May 13, 2019 for SG Application No. 10201801579R.

Examination Report for AU Application No. 2018203865 dated Aug. 14, 2019.

Search Report & Written Opinion for SG Application No. 10201804982S dated Aug. 21, 2019.

Final Action for U.S. Appl. No. 15/998,000 dated Sep. 9, 2019.

Office Action for U.S. Appl. No. 15/894,090 dated Sep. 20, 2019.

Office Action for U.S. Appl. No. 15/112,038 dated Sep. 20, 2019.

Chinese Office Action dated Jan. 3, 2020 issued in corresponding CN Application No. 201810096721.5 cites the patent documents above.

U.S. Office Action dated Apr. 17, 2020 issued in corresponding U.S. Appl. No. 15/998,000 cites the patent documents above.

U.S. Office Action dated Jun. 26, 2020 issued in corresponding U.S. Appl. No. 15/894,090 cites the patent documents above.

Office Action dated Jul. 13, 2018 for U.S. Appl. No. 15/112,038.

Office Action dated Jul. 26, 2018 for U.S. Appl. No. 15/894,090.

U.S. Office Action dated Nov. 20, 2018 for U.S. Appl. No. 15/998,000.

U.S. Office Action dated Jan. 10, 2019 for U.S. Appl. No. 15/112,038.

U.S. Office Action dated Jan. 10, 2019 for U.S. Appl. No. 15/894,090.

International Application No. PCT/JP2015/000171, International Search Report and Written Opinion dated Mar. 27, 2015.

Written Opinion of the Intellectual Property Office of Singapore dated Oct. 7, 2017 issued in corresponding Singapore Application No. 11201605347T.

Search Report of the Intellectual Property Office of Singapore dated Jul. 7, 2017 completed in corresponding Singapore Application No. 11201605347T.

Office Action dated Dec. 1, 2017 for EP Application 15701853.2

Office Action dated Jun. 29, 2017 for New Zealand Application 721845.

Office Action dated Sep. 8, 2017 for parent application, U.S. Appl. No. 15/112,038.

Office Action dated Jul. 13, 2018 for parent application, U.S. Appl. No. 15/112,038.

U.S. Final Office Action dated Nov. 10, 2020 issued in U.S. Appl. No. 16/150,378 cites the patent document above.

* cited by examiner

CARD GAME MONITORING SYSTEM

CROSS-REFERENCE TO RELATED APPLICATION

The present application is a continuation from U.S. application Ser. No. 15/112,038 filed Jul. 15, 2016, which is a 35 USC. § 371 national phase application from International Application No. PCT/JP2015/000171 filed Jan. 16, 2015, which claims priority to AU Application No. 2014200314 filed Jan. 14, 2014, each of which is hereby incorporated by reference in its entirety.

TECHNICAL FIELD

The present invention relates to a table game monitoring system for a table game using playing cards from a shoe having multiple decks that have been shuffled together prior to the beginning of play in which bettors make wagers on betting areas of a game table in front of the bettors. This table game monitoring system monitors whether or not wagers of winning bettor(s) move to appropriate area of the winner(s).

BACKGROUND ART

Baccarat and Black Jack are of the many live table games played in casinos or gaming establishments. These games use a standard deck of 52 playing cards and are usually dealt from a shoe having multiple decks (6 to 9 or 10 decks) that have been shuffled together prior to the beginning of play. When operating people (hereinafter "the dealer") in casinos deliver playing cards to a game table for plays in such games, any loss of cards or exchange of cards between bettors, etc. should not occur, and also wagers with payoffs must correctly go to the winners of the bettors after each game has ended.

To assure fair games by preventing such loss or exchanges during games, the game tables in casinos should be administrated so that games at tables are played properly (i.e. there is no exchange of cards or any other accidental or fraudulent acts etc.) and wagers are correctly paid off to the winners. A system to monitor the game tables by camera is known and is disclosed in Patent Literature 1: (U.S. Pat. No. 6,582,301). This known system only monitors the table game and records whole games for later analysis if it is believed that some inappropriate act has occurred.

U.S. Pat. No. 6,582,301B

SUMMARY OF INVENTION

The present invention provides a real-time monitoring of the table game and enables the casino to stop an ongoing game immediately when something unexpected happens by administrating the whole game from the start to the end of the game.

The present invention has been made in view of the above problem, and aims to provide a table game monitoring system with which it is possible to allow a casino to stop an ongoing game immediately when something unexpected happens by administrating the whole game from the start to the end of the game and during payoffs.

To solve the above conventional problems, the present invention provides the card game monitoring system having: a game table on which bettors make wagers on betting areas, a card shooter apparatus that is put on the game table and has a card reading unit that reads the number (rank) of the card and having a control unit to determine a winning hand according to a table game rules based on information of numbers of the cards sequentially read by the card reading unit and a monitor video camera system to capture positions of the card delivered from the card shooter apparatus to bettors and identify wagers on each betting area at the game table, the control unit has a processing function using the information of the monitor video camera system to determine: 1) head-count of the bettors playing each game by identifying the wagers on each betting area or cards delivered to bettors, 2) whether or not each bettor gets more than two cards from the card shooter apparatus, 3) each hand of the bettors and the dealer according to the information read by the card shooter apparatus using the information of head-count of the bettors according to the game rule, and 4) the winner(s) having the winning hand(s) in the game according to the game rule based on the information of the each hand of the bettors and the dealer, wherein the monitor video camera system further reads movements of wagers on the game table, and the control unit having further processing function to check whether wagers with payoffs move to the winner of the bettor determined by the card shooter apparatus at the end of each game.

In the card game monitoring system, the control unit has further processing function to identify ranks of playing cards on the game table delivered by a dealer and to check and report whether ranks of cards are the same as the ones determined by the card shooter apparatus.

DESCRIPTION OF EMBODIMENTS

Figure 1:
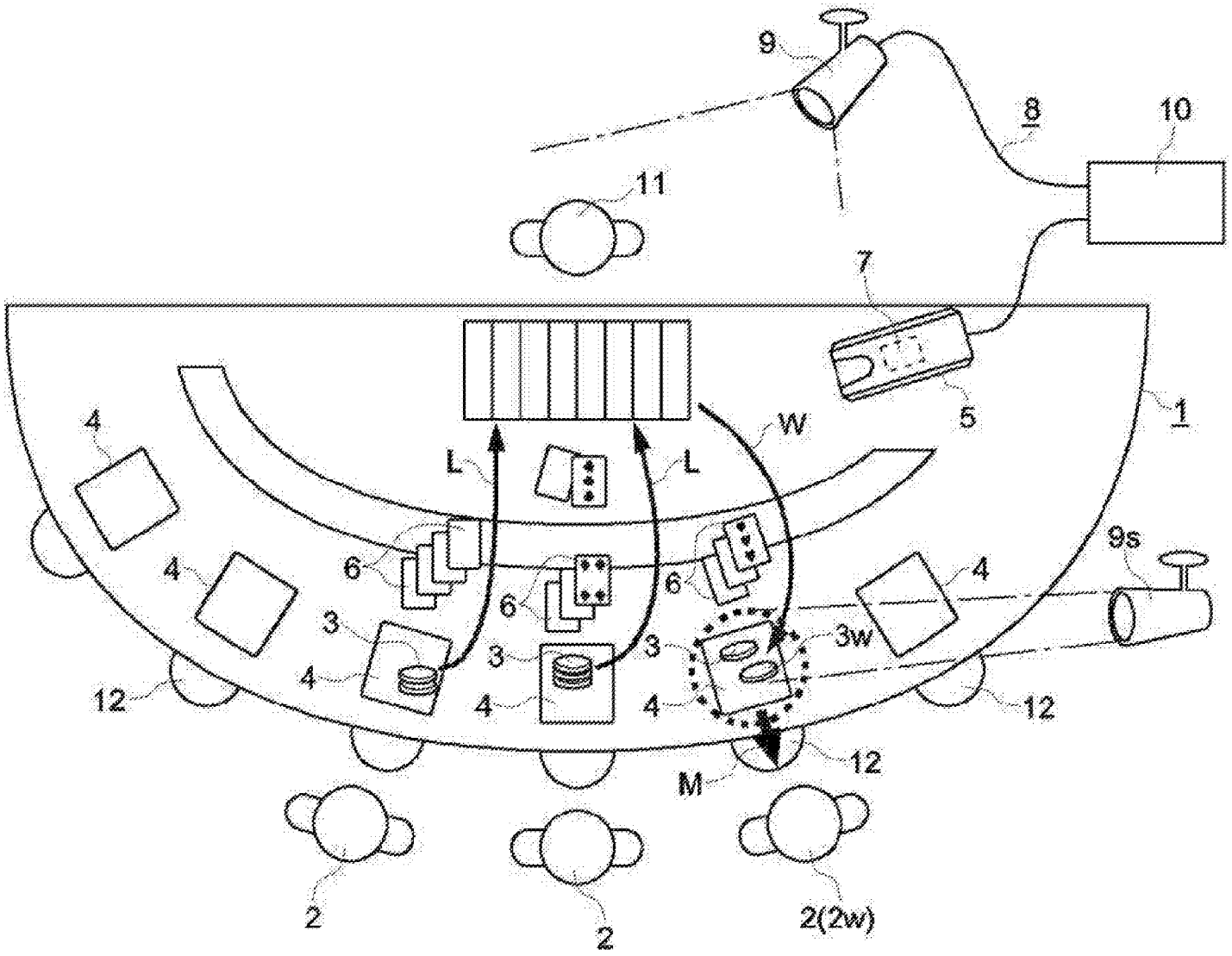
FIG. 1 is a diagram schematically showing the entirety of a table game system according to an embodiment 1 of the present invention.

Embodiment 1 of the present invention will be described with reference to the attached drawings. Embodiment 1 of the present invention provides a card game monitoring system for playing Black Jack. In FIG. 1, the card game monitoring system has: a game table 1 on which bettors 2 make wagers by putting wagers 3 on betting areas 4; a card shooter apparatus that is put on the game table 1 and has a card reading unit that reads the number (rank) and suit of the cards 6 and having a control unit 7 to determine a winning hand according to a table game rule based on information of numbers (ranks) of the cards sequentially read by the card reading unit 5.

A monitor video camera system 8 which has several cameras 9 is set above each game table 1 to capture the positions of cards 6 delivered from the card shooter apparatus 5 to bettors 2. The monitor video camera system 8 identifies wagers 3 on each betting area 4 at the game table 1, the control unit 10 has a processing function using the information of the monitor video cameras 9 to determine the following: 1) head-count of the bettors playing on each game by identifying the positions of wagers on each betting area or cards delivered to each bettor 2 (three persons (heads) shown in FIG. 1), 2) number of cards delivered for each bettor 2 by dealer 11 from the card shooter apparatus 5 (whether or not each bettor 2 gets more than two cards).

The control unit 10 has further processing function using information from the monitor video cameras 9 to determine each hand of the bettors 2 and the dealer 11 according to the information read by the card shooter apparatus 5 using the information of the results of head-counting of the bettors 2 and according to the game rules installed in the control unit 7 of the card shooter apparatus 5. Then the control unit 7 will determine the winner W having the winning hand on the game based on the information of the hands of the bettors 2 and the dealer 11.

Wherein the card shooter apparatus 5 knows directions of each card (who gets each card read by the card shooter apparatus 5 through the monitor video camera system 8) and then the card shooter apparatus 5 (the control unit 7) will figure out by its programs the hands held by the bettors 2 and the dealer 11. The control unit 10 has further a processing function to check whether wagers 3 with payoffs 3W move to a pool 12 of the winner 2W of the bettors 2 determined by the card shooter apparatus 5 at the end of each game (the movement M for the winners and L for loser in FIG. 1).

The monitor video camera system 8 (with the control unit 10) has further processing function that identify ranks of playing cards 6 by analyzing pictures from the monitor video cameras 9 to determine each hand (number) of the bettors 2 on the game table delivered by a dealer 11 and checks whether suits and ranks of cards 6 are the same as the ones read and determined by the card shooter apparatus 5.

The monitor video camera system 8 (the control unit 10) has further processing function that identifies total amounts of wagers 3 by counting chips on each betting area 4 of the bettors 2. Each total amount of wagers 3 are calculated by analyzing pictures from the monitor video cameras 9 of its colors and its height of chips on each betting areas 4. Special video cameras 9*s* for this purpose may be put around the game table 1 to take side views of the chips of wagers 3.

Figure 2:
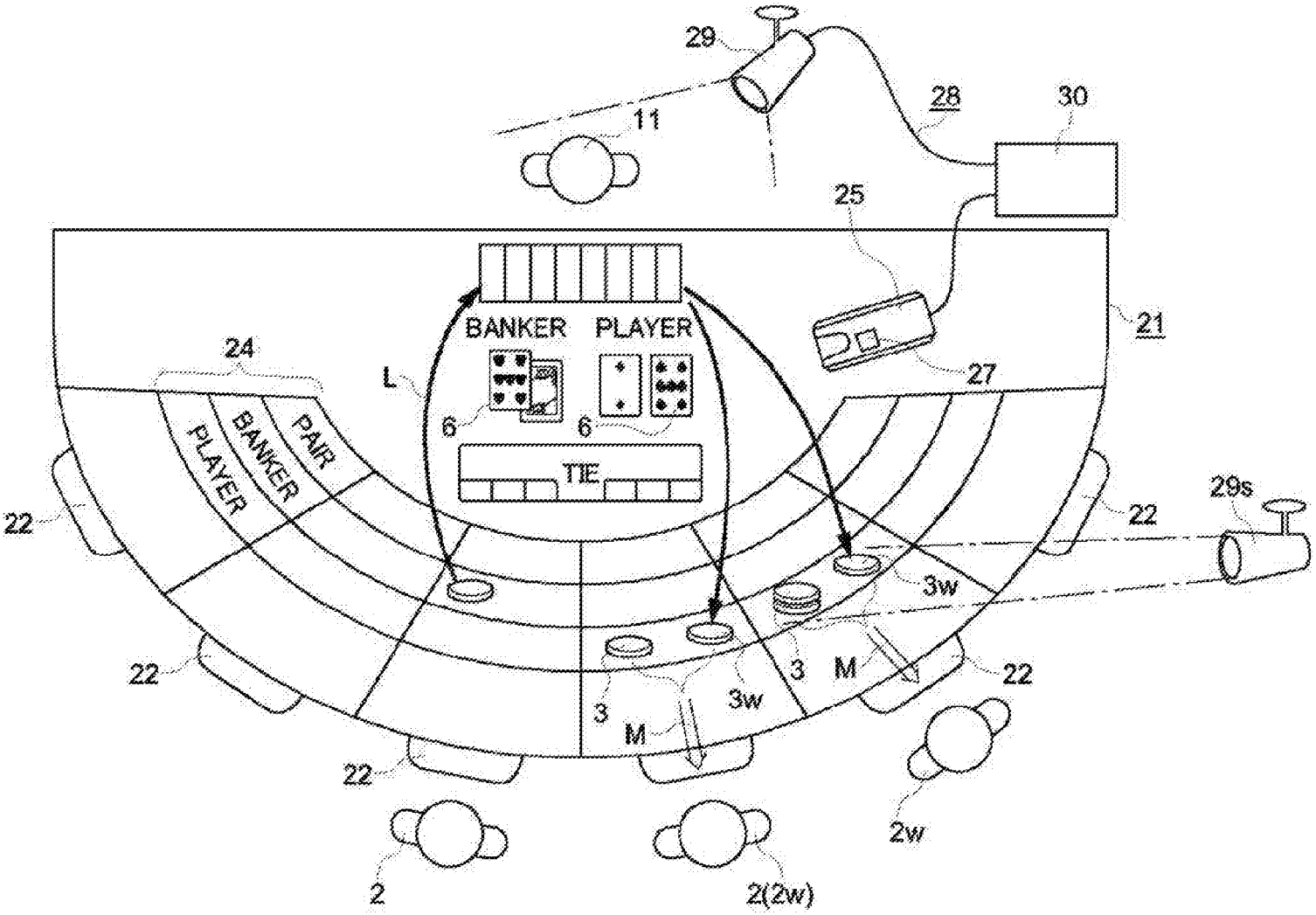
FIG. 2 is a diagram schematically showing the entirety of a table game system according to an embodiment 2 of the present invention.

FIG. 2 shows an example of Embodiment 2 of the present invention. Embodiment 2 of the present invention provides a card game monitoring system for playing game (Baccarat). In FIG. 2, the card game monitoring system has: a game table 21 on which bettors 2 make wagers by putting wagers 3 on betting areas 24; a card shooter apparatus 25 that is put on the game table 21 and has a card reading unit that reads the number (rank) and suit of the cards 6 and having a control unit 27 to determine a winning hand according to a table game rule based on information of numbers (ranks) of the cards 6 sequentially read by the card shooter apparatus 25.

A monitor video camera system 28 reads cards and movements of the wagers 3 on the game table. The control unit 27 of the card shooter apparatus 25 has processing functions to determine whether the winning hand is the Banker or the Player based on information of numbers (ranks) of the cards read by the a card shooter apparatus 25 and Baccarat game rule in the control unit 27. A control unit 30 of the card game monitoring system having processing function to check whether wagers 3 with payoffs 3W move to a pool 22 of the winners 2W of the bettors 2 after each game has ended.

Wherein the card shooter apparatus 25 knows that place (Banker or Player) to which each card is delivered according to the game rule of Baccarat and then the card shooter apparatus 25 (with the control unit 27) will calculate each hand of Banker and Player. In this way the card shooter apparatus 25 determines whether a winning hand is the Banker or the Player. The control unit 30 has a further processing function to check whether wagers 3 with payoffs 3W move to a pool 22 of the winner 2W of the bettors 2 determined by the card shooter apparatus 25 at the end of each game (the movement M for the winners and L for loser movement M in FIG. 2).

The monitor video camera system 28 (with the control unit 30) has further processing function that identify ranks of playing cards 6 on the game table 21 delivered by a dealer 11 by analyzing pictures obtained from the monitor video cameras 29. This card game monitoring system checks whether suits and ranks of cards 6 are the same as the ones read and determined by the card shooter apparatus 25 and reports to an administration section of the casino the results of whether the suits and ranks of cards 6 are the same as those delivered and read by the card shooter apparatus 25.

The monitor video camera system 28 (the control unit 30) has further processing function that identify total amounts of wagers 3 by counting chips on each betting area 24 of the bettors 2. Each total amount of wagers 3 is calculated by analyzing pictures from the monitor video cameras 29 of its colors and its height of chips on each betting areas 24. Special video cameras 29*s* for this purpose may be put around the game table 21 to take side views of the chips of wagers 3.

In both examples of Embodiment 1 and 2 the monitor video camera system 8 and 28 can identify positions of wagers 3, the total amount of wagers 3 of its colors and its height of chips on each betting areas 4 and 24 by analyzing pictures taken by the video cameras 9, 9*s*, 29 and 29*s* using CCD and through known technology of vision analysis. The monitor video camera system 8 and 28 can also identify positions of cards 3 and analyze the faces of cards showing in betting.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Annex 1

The card game monitoring system mentioned above, the card shooter apparatus has further determination function of the card games when each game starts and ends according to the rules of Baccarat or Black Jack with monitoring video camera system.

Annex 2

The card game monitoring system mentioned above, the control unit has further processing function to check whether wagers do not move from the original betting position to the other area during the each game starts and ends (during each game).

Annex 3

The card game monitoring system mentioned above, the control unit has a determination function to determine when the betting starts before the start of each game (the betting start indicates the time the first bet is put on the betting area).

Annex 4

The card game monitoring system mentioned above, the control unit has a determination function to determine when the betting ends before the start of each game (the betting end indicates the time the first card is delivered from the card shooter apparatus). Also the control unit has a processing function using the information from the monitor video camera system to determine the movement of the dealer's hand representing the end of betting called "No more bet".

Annex 5

The card game monitoring system mentioned above, the control unit has a determination function to determine when the payoff has completed after the end of each game.

Annex 6

The card game monitoring system mentioned above, the control unit has a transmitting function to transmit the information of the monitor video camera to a backyard in casino.

Annex 7

The card game monitoring system mentioned above, the control unit has a determination function to determine an error, and the card game monitoring system further has an output means to output an error signal by displaying and/or alarming in the card shooter apparatus and/or the related system components incorporated in the card game monitoring system as a result of the determination of the error. The error mentioned above includes at least one of the following items: 1) The ranks of playing cards identified by the card game monitoring system on the game table delivered by the dealer are not same as the ones determined by the card shooter apparatus; 2) Wagers have moved from the original betting position to other areas during each game; and 3) Wagers with payoffs have not moved to the winners of the bettors at the end of each game.

Annex 8

The card game monitoring system mentioned above, the control unit has a determination function to identify a cut card delivered from the card shooter apparatus.

The invention claimed is:

1. A monitoring system for a game in which one or more bettors place one or more wagers, the monitoring system comprising:

a game table that includes betting areas;

a card shooter apparatus comprising a card reading unit that includes a card reader, wherein the card reader is configured to read ranks of cards and wherein the card shooter apparatus is configured to determine a start of the game and is configured to determine an end of the game based on predefined game rules;

a camera system, wherein the camera system is configured to, for each of the betting areas, when a respective one of the one or more wagers is placed on the respective betting area, identify the respective wager wagered on the respective betting area; and a control unit, wherein the control unit is configured to:

1) determine a number of the one or more wagers that have been placed and respective positions of the one or more wagers by utilizing an output of the camera system;

2) determine one or more winners of the game according to the predefined game rules and based on one or more hands respectively of the one or more bettors and a hand of the dealer, the hands being formed by respective subsets of the cards;

3) identify, based on the start of the game and the end of the game determined by the card shooter apparatus, a wager-closure period during at least a part of which an entirety of the game is played;

4) based on output of the camera system, determine whether any of the one or more wagers moves during the wager-closure period from one of the betting areas at which the respective wager was positioned at a time of a start of the wager-closure period to another area; and 5) trigger output of an alert responsive to a result of the determination of whether any of the one or more wagers moves during the wager-closure period being positive.

2. The monitoring system according to claim 1, wherein the control unit is configured to identify ranks of the cards on the game table dealt by the dealer and to verify that the ranks of the dealt cards are identical to the ranks of the cards read by the card reader.

3. The monitoring system according to claim 1, wherein the camera system is configured to detect a direction of movement of the one or more wagers on the game table, and wherein the control unit is configured to verify that any one or more of the one or more wagers for which there is a respective payoff moves to a corresponding bettor of the one or more bettors associated with a winning hand at an end of the game.

4. A card game monitoring system for a game in which one or more wagers are placed, the card game monitoring system comprising:

a game table that includes a betting area associated with a Banker's hand and a betting area associated with a Player's hand;

a card shooter apparatus, wherein the card shooter apparatus is configured to read respective ranks of cards as the cards are respectively dealt, is configured to determine a start of the game, and is configured to determine an end of the game based on predefined game rules;

a camera system, wherein the camera system is configured to detect the one or more wagers when the one or more wagers are on the game table; and a control unit, wherein the control unit is configured to:

determine whether a winning hand of the game is the Banker's hand or the Player's hand according to the predefined game rules and the ranks of the dealt cards, the winning hand being formed by a subset of the dealt cards;

identify, based on the start of the game and the end of the game determined by the card shooter apparatus, a wager-closure period during at least a part of which an entirety of the game is played;

based on output of the camera system, determine whether any of the one or more wagers moves during the wager-closure period from one of the betting areas at which the respective wager was positioned at a time of a start of the wager-closure period to another area; and trigger output of an alert responsive to a result of the determination of whether any of the one or more wagers moves during the wager-closure period being positive.

5. The card game monitoring system according to claim 4, wherein the control unit is further configured to verify whether one or more payoffs are correctly paid after the game has ended.

6. The card game monitoring system according to claim 4, wherein the control unit is further configured to identify the ranks of the cards on the game table and verify whether the ranks of the cards on the game table are the same as those read by the card shooter apparatus.

7. The card game monitoring system according to claim 4, wherein the card shooter apparatus is configured to determine when the game starts.

8. The card game monitoring system according to claim 4, wherein the camera system is further configured to identify the cards.

* * * * *